US006086444A

United States Patent [19]

Glickman

[11] Patent Number: 6,086,444

[45] Date of Patent: Jul. 11, 2000

[54] BLOCK-TYPE CONSTRUCTION TOY

[75] Inventor: Joel I. Glickman, Huntingdon Valley, Pa.

[73] Assignee: Connector Set Limited Partnership, Hatfield, Pa.

[21] Appl. No.: 09/218,115

[22] Filed: Dec. 21, 1998

[51] Int. Cl.[7] ..... A63H 33/08

[52] U.S. Cl. ..... 446/124; 446/85; 446/120; 446/125; 446/128

[58] Field of Search ..... 434/81, 159, 160, 434/171, 172, 177, 211, 213, 214, 403, 406; 446/124, 125, 128, 117, 119, 126, 127, 85

[56] References Cited

U.S. PATENT DOCUMENTS

| | | | |
|---|---|---|---|
| 2,106,148 | 1/1938 | Kellner . | |
| 2,714,269 | 8/1955 | Charles . | |
| 3,162,973 | 12/1964 | Christiansen | 446/128 |
| 3,220,141 | 11/1965 | Goss, III . | |
| 3,487,579 | 1/1970 | Brettingen . | |
| 3,496,670 | 2/1970 | Sloop et al. . | |
| 3,611,621 | 10/1971 | Folson . | |
| 3,852,909 | 12/1974 | Viebcke . | |
| 3,877,170 | 4/1975 | Bakker . | |
| 4,246,718 | 1/1981 | Chatani . | |
| 4,305,221 | 12/1981 | Chatani . | |
| 4,306,373 | 12/1981 | Chatani et al. . | |
| 5,477,433 | 12/1995 | Perry, Jr. . | |
| 5,620,352 | 4/1997 | Tzong | 446/120 |
| 5,683,283 | 11/1997 | Glynn . | |
| 5,725,411 | 3/1998 | Glynn . | |
| 5,853,314 | 12/1998 | Bora | 446/120 |

FOREIGN PATENT DOCUMENTS

| | | |
|---|---|---|
| 229861 | of 0000 | Australia . |
| 0 039 100 | of 0000 | European Pat. Off. . |
| 1150976 | of 0000 | France . |
| 1180316 | of 0000 | France . |
| 24 29 491 | of 0000 | Germany . |
| 1049484 | of 0000 | United Kingdom . |
| 935308 | of 0000 | United Kingdom . |

*Primary Examiner*—Bena B. Miller
*Attorney, Agent, or Firm*—Schweitzer Cornman Gross & Bondell LLP

[57] ABSTRACT

A building block for a construction toy is characterized by having one or more studs projecting from one side and a corresponding number of recesses formed in the opposite side. The studs and recesses are of an equilateral polygonal configuration, preferably having an even number of sides, preferably eight. At least some of the surfaces of the studs are formed to have a negative taper, making the studs slightly larger at the top than at the base. The recesses also are formed such that the walls have a slight negative taper, making the recesses slightly narrower at the open end than farther down in the recess. When a pair of blocks is assembled by inserting one or more studs of one block into one or more recesses of an adjacent block, the negatively tapered configuration of the studs and recesses provides for a tactilly sensible snap action, which is pleasing to the user and also provides a secure assembly. The height of the studs, in relation to their width, is relatively low, which facilitates disassembly of connected blocks, when desired, by applying tilting force to the blocks.

10 Claims, 8 Drawing Sheets

FIG. 5
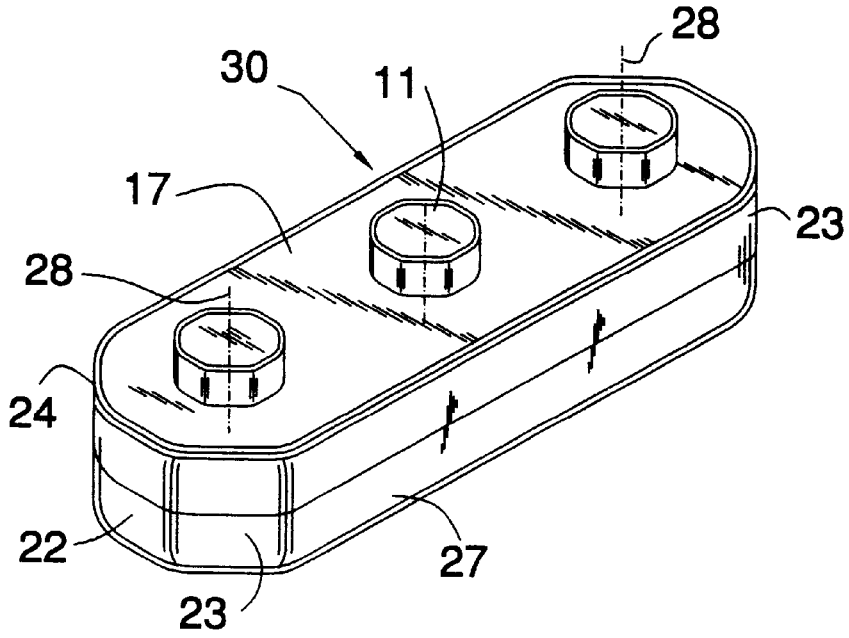
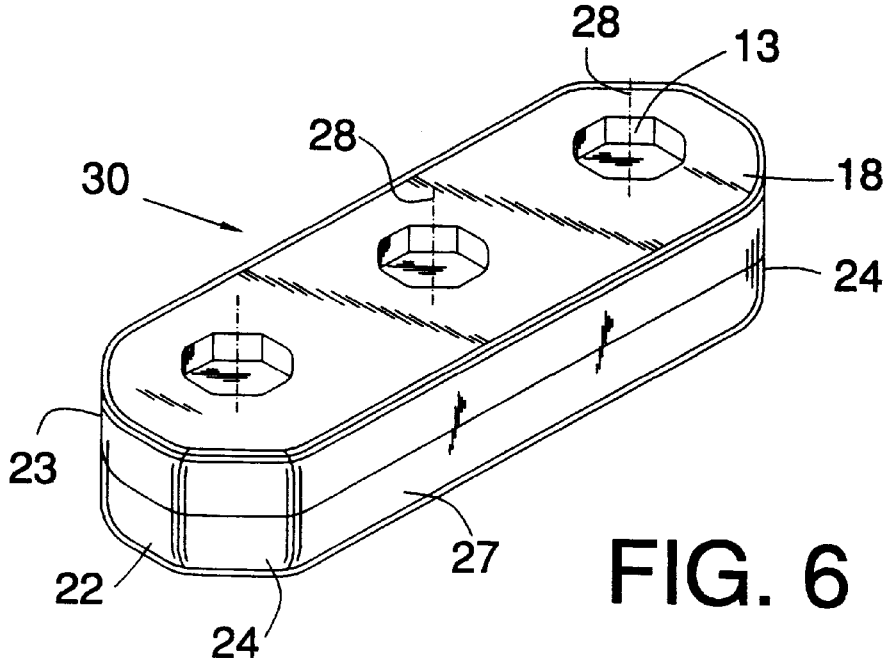
FIG. 6

FIG. 7
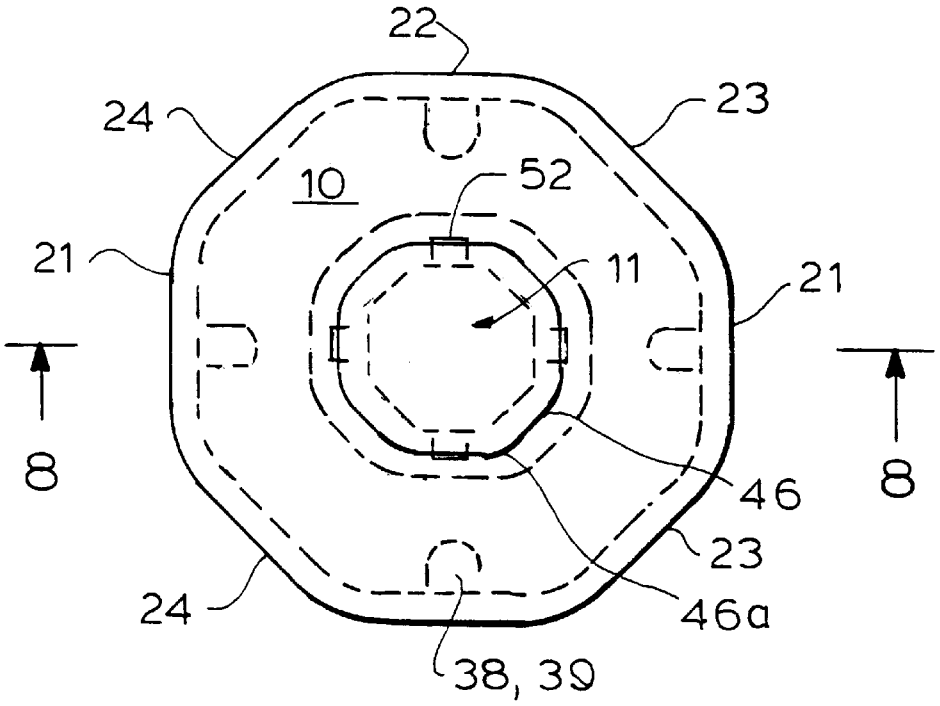
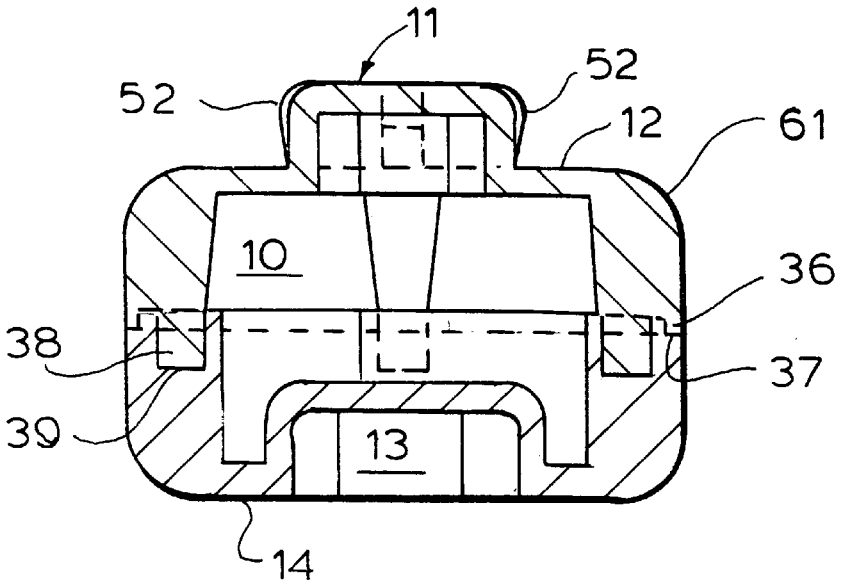
FIG. 8

FIG. 11
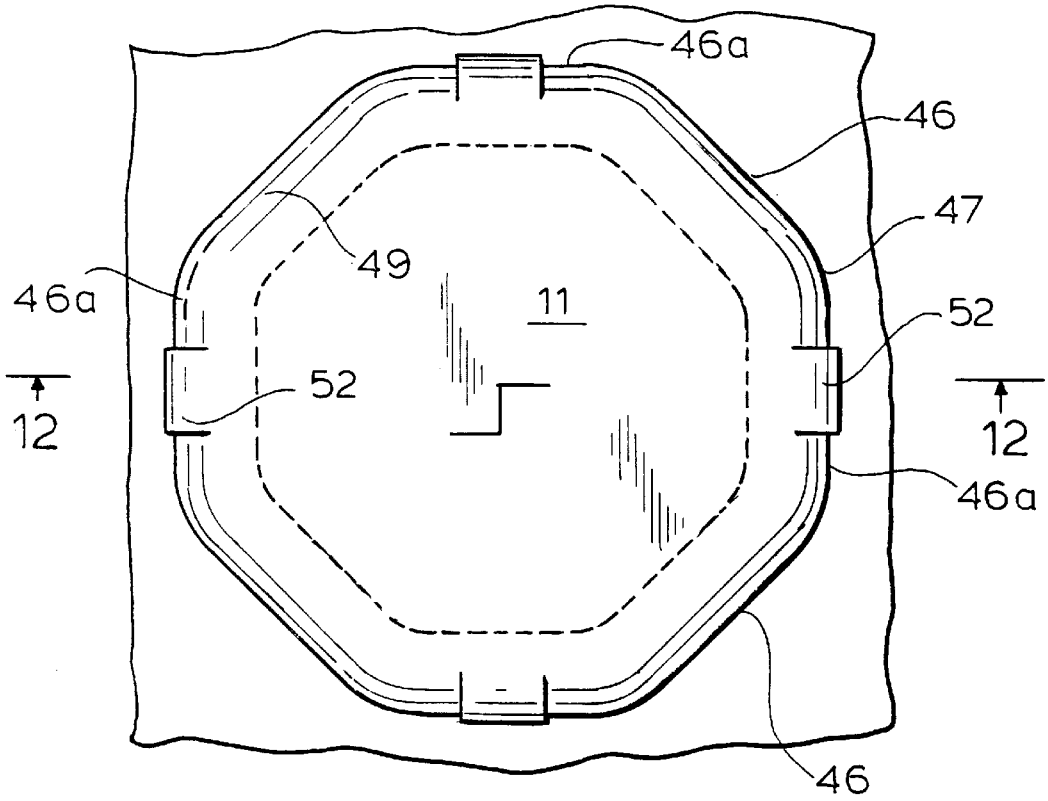
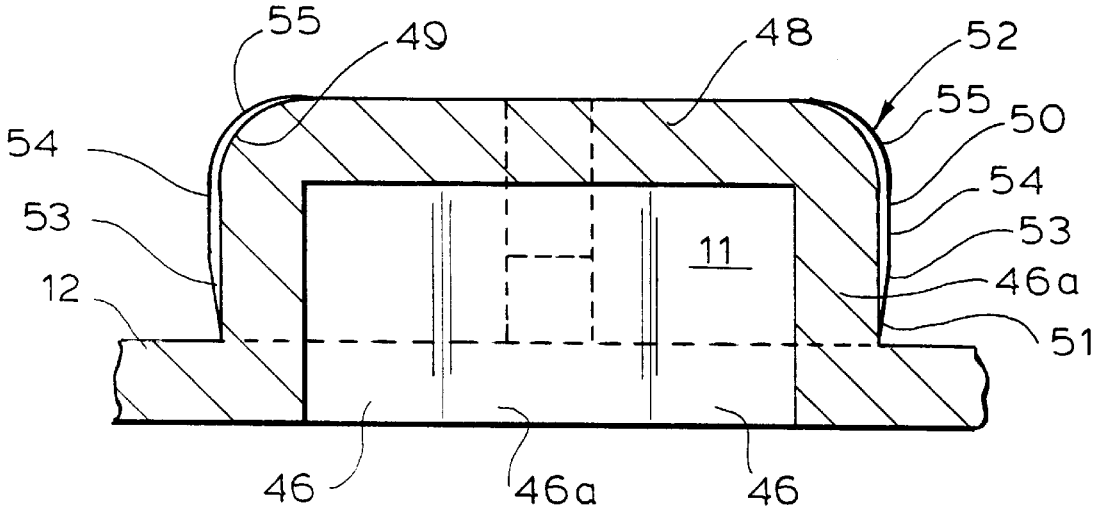
FIG 12

BLOCK-TYPE CONSTRUCTION TOY

BACKGROUND AND SUMMARY OF THE INVENTION

The present invention is directed to construction toy sets, and more particularly to improvements in construction toy sets of the type in which the components are individual blocks formed with projecting studs and/or recesses to enable assemblies to be constructed by joining projecting studs of one block with recesses of another.

In general, construction toys utilizing blocks with studs and recesses are well known and are commercially available. The present invention is directed to improved features in building blocks of this general type, to the end of making them easier and more desirable to use, more securely joined when assembled, yet readily disassembled when desired.

In a preferred form of the invention, individual building blocks are comprised of upper and lower shells, formed of injection molded plastic, which are joined together, preferably permanently, to form a lightweight, hollow block. For convenience, but without intending any limitation, one of the halves may be referred to herein as the top and the other as the bottom.

One or more studs, integral with the top of the block, extend upward therefrom and, in a preferred embodiment, a corresponding number of recesses of similar configuration are formed in the bottom of the block. It is also contemplated that, in certain cases, blocks may be provided with only studs or only recesses, or with studs and recesses in different number.

Although other configurations are possible and contemplated within the basic teachings of the invention, in a particularly preferred and advantageous form of the invention the studs and recesses are configured in the form of equilateral octagons. In each block, the studs and recesses are of equal number and are arranged in coaxial pairs, with each stud being coaxial with a corresponding recess on the opposite side of the block, and the sides of all of the studs and recesses being oriented in the same manner.

In accordance with one of the features of the invention, the side walls of the recesses are formed to give the recesses a slight negative taper. That is, the width of the recess opening, at the surface of the block, is slightly less than the width of the recess at a distance from its surface opening. In a similar manner, some or all of the side walls of the projecting studs are configured to provide a slight negative taper, such that the cross section of the stud at the base is slightly smaller than at the top, and at least some of the width dimensions at the top of the stud are at least slightly greater than the width of the openings into the recesses. Accordingly, in order to insert a stud into a recess, the end of the stud has to be forced into the recess opening, and the assembly is accomplished with a tactilly sensible snap action effect. Once assembled, the parts are securely held in place by the fit of the reversely tapered stud and recess walls.

Desirably, the studs are of substantially greater width than height. This is made possible and practicable by relying upon the snap fit interlock of the studs and recesses, to maintain adjacent blocks in assembled relation, rather than relying on a simple friction fit as is customary with such devices. The relatively short projecting length of the studs facilitates disassembly of connected blocks by enabling one block to be more easily tilted with respect to another, providing leverage to effect separation of the interlocking parts.

In an advantageous form of construction toy building block according to the invention, the blocks are formed with opposite side walls which are spaced apart and parallel, and end walls arranged in the form of three sides of an octagon. In a block with a single projection and/or single recess, the body of the block is of octagonal configuration arranged concentrically with the stud and/or recess, with side walls of the block body being parallel with corresponding side walls of the stud and/or recess. For larger blocks, formed with a plurality of sets of studs and/or recesses, the side walls are appropriately elongated.

For a more complete understanding of the above and other features and advantages of the invention, reference should be made to the following detailed description of preferred embodiments of the invention and to the accompanying drawings.

DESCRIPTION OF THE DRAWINGS

FIGS. 5 and 6 are top and bottom perspective views respectively of a further embodiment of the invention in which the block is provided with three sets of studs and recesses.

FIG. 7 is a top plan view of the block of FIG. 1.

FIG. 8 is a cross sectional view as taken generally on line 8—8 of FIG. 7.

FIG. 11 is an enlarged, fragmentary top plan view showing the configuration of a stud according to the invention.

FIG. 12 is a cross sectional view as taken generally on line 12—12 of FIG. 11.

DESCRIPTION OF PREFERRED EMBODIMENTS

Figure 1:
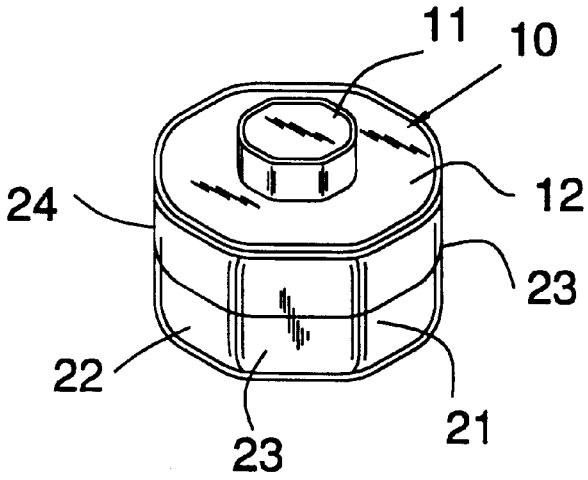
FIG. 1 is a top perspective view of a building block according to the invention, having a single stud and recess.
Figure 2:
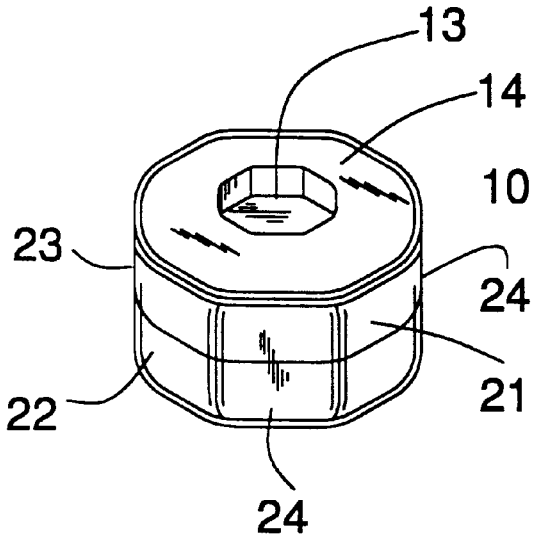
FIG. 2 is a bottom perspective view of the block of FIG. 1.
Figure 3:
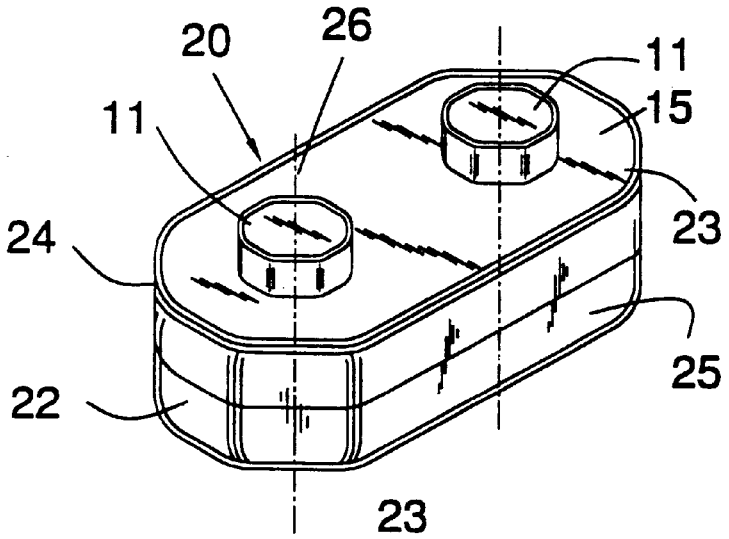
FIGS. 3 and 4 are top and bottom perspective views respectively of a building block according to the invention provided with two sets of studs and recesses.
Figure 4:
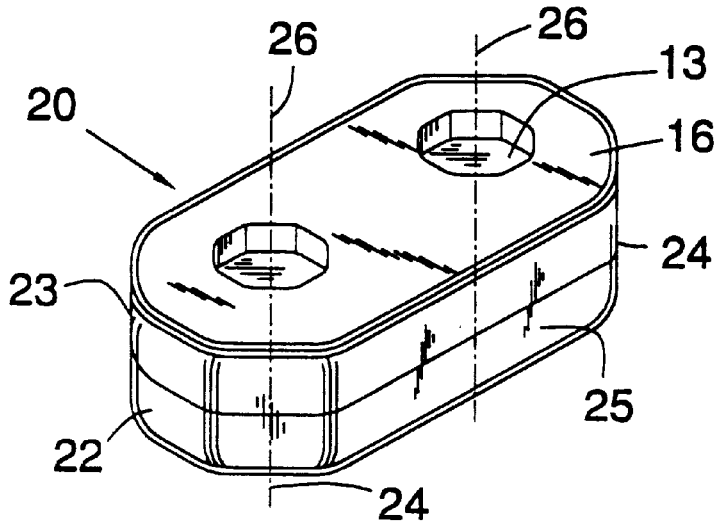

Referring now to the drawings and initially to FIGS. 1–6 thereof, there are shown three example styles of building blocks according to the invention. Block 10 of FIGS. 1–2 is formed with a single stud 11 on its top wall 12 and a single recess 13. Block 20 of FIGS. 3–4 is formed with a pair of studs 11 on its top wall 15 and a pair of recesses 13 on its bottom wall 16. Block 30 of FIGS. 5–6 is formed with three studs 11 on its top wall 17 and three recesses 13 in its bottom wall 18. In each of the illustrated embodiments, the studs are formed in coaxially aligned pairs. However, as will become apparent, the blocks may be configured with various combinations of studs and recesses, including all studs or all recesses, combinations of studs and recesses on the same and different sides, etc. The illustrated embodiments should therefore be considered as reflecting only general principles of the invention and not as limiting the scope thereof.

Pursuant to one aspect of the invention, the studs 11 and recesses 13 are configured in the form of equilateral polygons of substantially the same size, so that studs 11 of one block can be inserted into recesses 13 of a second block in one of a plurality of angular orientations, as determined by the number of sides of the polygon. To particular advantage, the studs and recesses are formed as equilateral octagons, providing for assembly of two blocks in any of eight possible orientations.

The blocks may of course be of any suitable size. For purposes of illustration, the blocks 10, 20, 30 may have a body thickness T (i.e., not including the projection of the studs 11) of about ¾ inch and an overall width W of about 1 ¼ inches. The block 10 of FIGS. 1–2, having a single stud and a single recess, is formed with opposed parallel side walls 21, and pairs of opposite end walls 22, 23, 24, also arranged in parallel relation. For the single stud block 10 the respective pairs of end walls 22–23, 23—23 and 24—24 are spaced apart the same distance W as the side walls 21, i.e., 1 ¼ inches in the illustration, so that the body walls 21–24 also form an equilateral octagon, with the stud 11 and recess 13 being arranged coaxially, centered with respect to the body walls 21–24, and with the several walls of the stud 11 and recess 13 being aligned in parallel relation to the body walls 21–24.

The two-stud block 20 illustrated in FIGS. 3–4 is comprised of elongated side walls 25, joined at the ends by end walls 22–24 of the same configuration as the end walls 22–24 of the single stud block 10 of FIGS. 1 and 2. The width and thickness of the two-stud block 20 are the same as for the single stud block 10. The overall length of the block 20 is, however, twice the "length" of the single stud block.

The axes 26 of the studs and recesses 11, 13 of the block 20 are aligned in a common plane bisecting the block 20 between its side walls 25. The axes 26 are spaced apart in a direction lengthwise of the block by a distance equal to the basic block width W, and the distance from the axes 26 to the adjacent end walls 22–24 (as well as to the opposite side walls 25) is equal to W/2. Accordingly, the length of the block 20 equals W*2.

As will be appreciated, the geometry of the blocks 10, 20 is such that two single stud blocks 10 may be assembled stud-to-recess with a two-stud block 20, on the same side of the latter, with adjacent side/end walls of the smaller blocks 10 abutting in the center of the larger block 20, and the remaining side/end walls of the smaller block being aligned with corresponding walls of the larger block.

The three-stud block 30 of FIGS. 5–6 is of the same width and thickness as the blocks 10, 20 previously described and has further elongated, parallel side walls 27 joined by end walls 22–24. The axes 28 of the three stud s and recesses 11, 13 are spaced apart by the distance W, and the end walls 22–24 are spaced from the endmost axes by a distance W/2. The overall length of the block 30 is thus W*3. The length of a block is thus seen to be a function L=W*n, where n=the number of studs and/or recesses.

Figure 9:
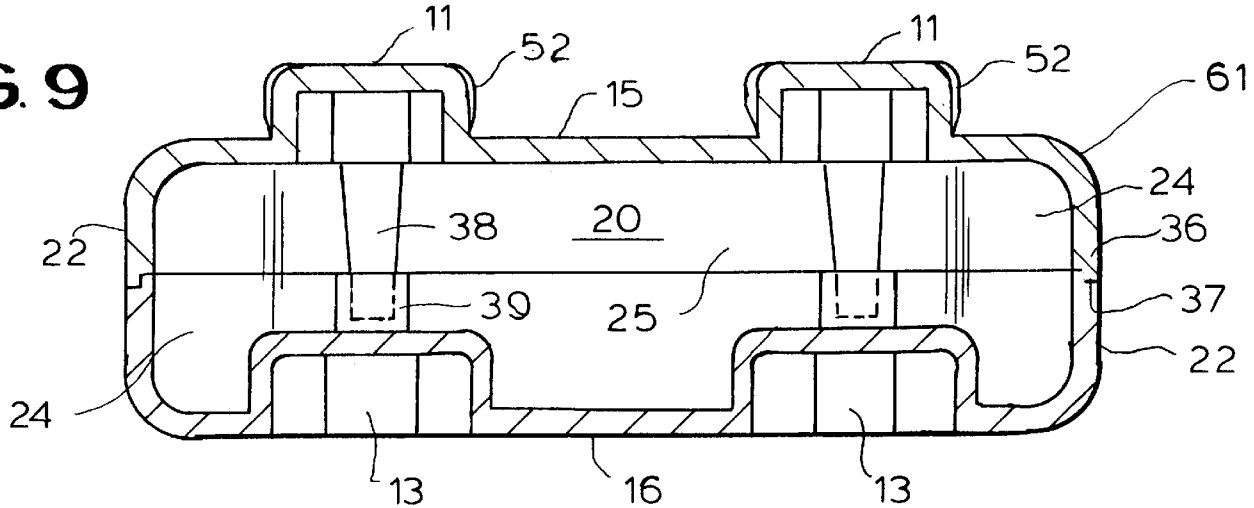
FIGS. 9 and 10 are longitudinal cross sectional views as taken generally along lines 9—9 and 10—10 respectively of FIGS. 3 and 5 respectively.
Figure 10:
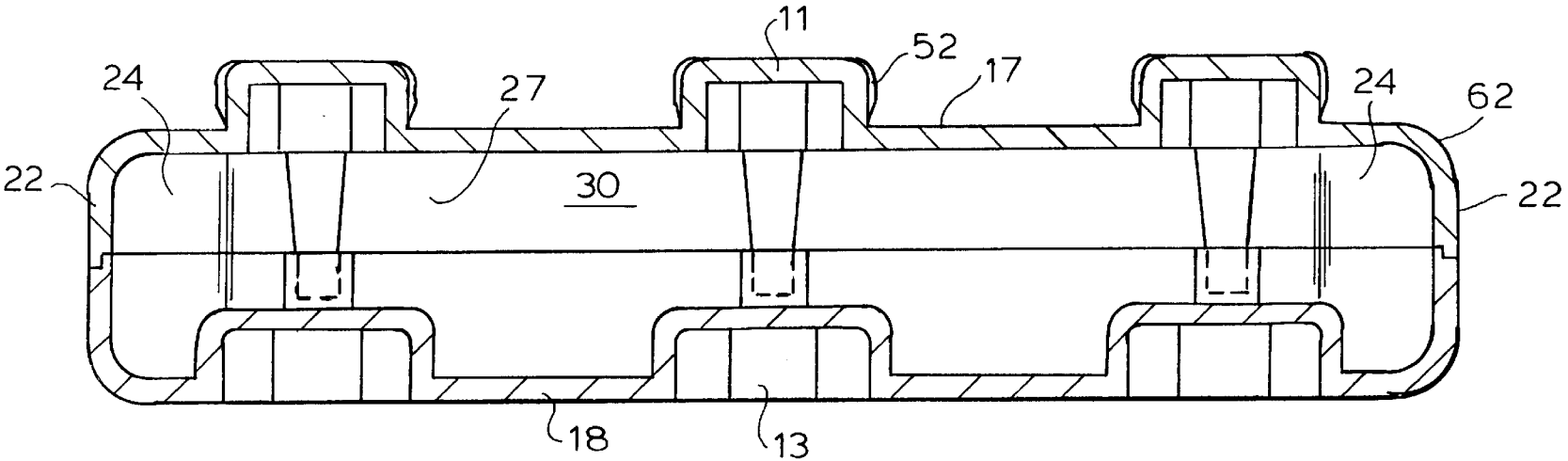

To advantage, the blocks 10, 20, 30 are formed by precision injection molding of a plastic material, such as ABS. The blocks are formed in upper and lower half sections 30, 31, or 32, 33, or 34, 35 as shown in FIGS. 8, 9 and 10 respectively. The half sections may be formed with wall thicknesses of, for example, 0.63 inch, to provide a lightweight and inexpensive construction. Desirably, the half sections are designed to be permanently joined to form a hollow block body, with studs and recesses formed integrally therein.

As shown in FIGS. 7–10, the upper half section of each block body is formed with a projecting lip 36 extending continuously around the periphery of the block and received in a complementary peripheral recess 37 to form a tight, secure closure of the two half sections and to accurately position the respective half sections in proper alignment. Additionally, each upper half section is provided with a plurality of integral alignment pins 38 which project below the peripheral lip 36 and are engageable with a snug friction fit in correspondingly positioned sockets 39 in the lower half sections of the blocks. Once assembled, the half sections form a rigid and durable block, which is solid in appearance but is light in weight and easily handled during play and during assembly and disassembly of structural combinations. Although it is possible to separate the upper and lower block halves after assembly, it is generally contemplated that the blocks will be permanently assembled.

Preferably, the blocks are brightly and distinctively colored according to size. Typically, both half sections of a block are formed of plastic material of the same color. However, it may be desired in selected cases to assemble blocks using half sections of contrasting colors.

As shown in FIGS. 11–16, and in accordance with a feature of the invention, both the studs and recesses 11, 13 are configured to have a slight reverse taper, such that the top of a stud has slightly greater dimensions than the opening into a recess, providing an interference fit at the beginning of assembly of one block to another. The nature of the reverse taper configuration is such that, once a stud is forced into the entrance opening into a recess 13, the respective elements are combined with a snap action effect. This not only provides for a secure combining of blocks, but also provides a satisfactory "feel" to the user during the assembly.

Figure 13:
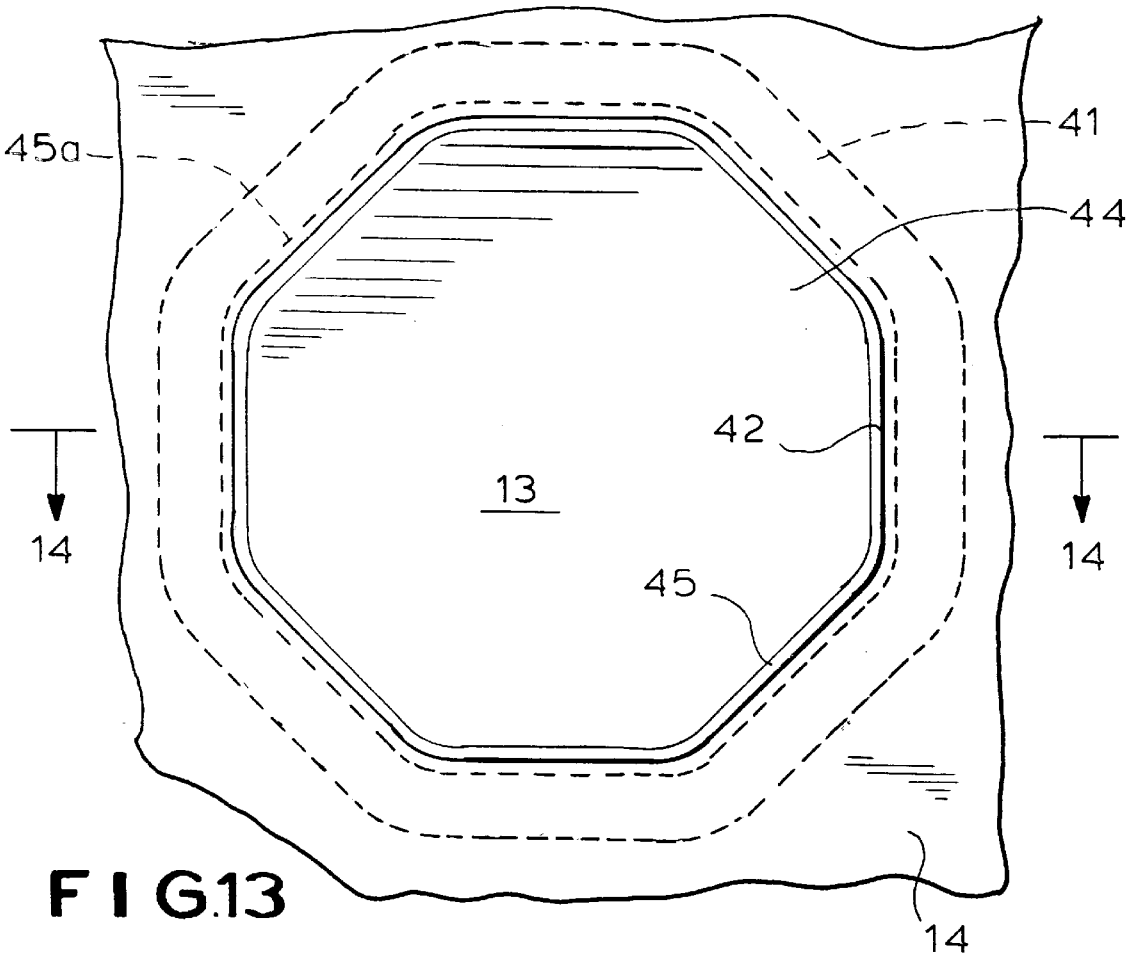
FIG. 13 is an enlarged fragmentary plan view from the bottom of a block, showing details of configuration of a recess.
Figure 14:
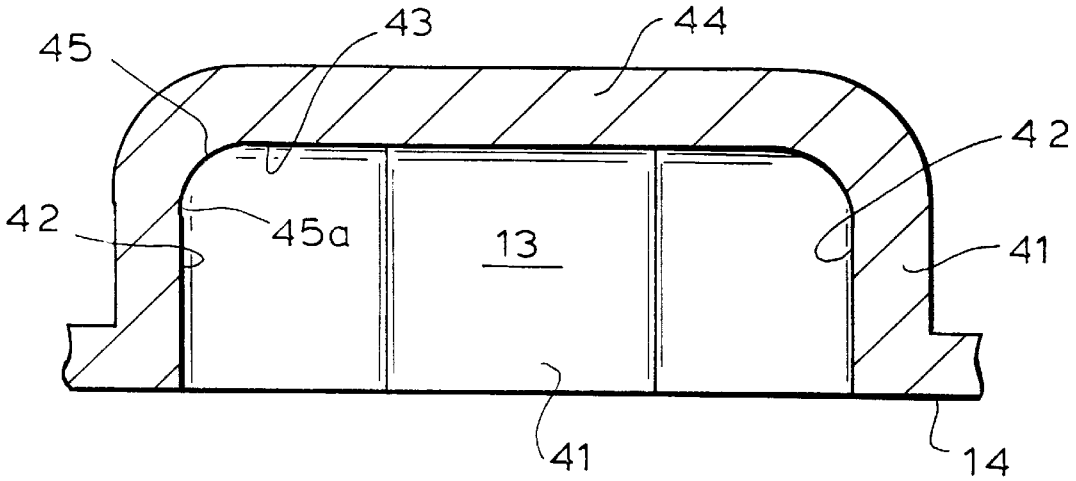
FIG. 14 is a cross sectional view as taken generally on lines 14—14 of FIG. 13.

As shown in FIGS. 13 and 14, for example, the side walls 41 defining the recesses 13 form a slightly acute angle with respect to the bottom wall 14 of the block. Typically, an acute angle of 89° between the inner surfaces 42 of the side walls 41 provides a one degree negative taper in the recess. Desirably, the mouth dimension of the recess, between opposed inner walls surfaces 42 is 0.500 inch at the surface of the bottom wall 14, and the width of the recess is slightly larger than that nearer the inner surface 43 of the recess bottom wall 44. Typically, as will be hereinafter described, the outer edges of the studs 11 are rounded off. Accordingly, the corners 45, joining the side walls 41 with the bottom walls 44 of the recesses may be correspondingly rounded with a corner fillet, as indicated at 45. The widest portion of the recess 13 in such cases will be adjacent the beginning of the corner fillet 45, indicated by the dotted line **45*a* in FIG. 13**.

FIGS. 11 and 12 illustrate an advantageous configuration of the studs 11 according to the invention. Nominally, the studs 11 are formed with side walls 46, **46*a* forming a substantially equilateral octagon, with the width of the stud between first alternate parallel walls 46 being formed at about 0.494 inch, and with slightly greater width between second alternate walls 46*a* of about 0.500 inch, to mate with the recesses 13 as described with respect to FIGS. 13, 14. The studs 11 project upward from the surface of the top wall 12 a distance substantially less than the width of the studs. Thus, in a typical and advantageous embodiment of the invention, the stud height may be about 0.188 inch for a stud having a nominal width of 0.500 inch. Desirably, where the stud side walls 46, 46*a* join, the corner is rounded with for example a radius of 0.125 inch, as indicated at 47 in FIG. 11. Likewise, where the side walls 46, 46*a* join with the stud top wall 48, the corners are rounded as at 49**, with a typical radius of about 0.063.

Pursuant to the invention, selected ones of the stud side walls are formed to have a negative taper, so that upper portions 50 of the studs are of greater width dimensions than lower portions 51 thereof (see FIG. 12). In the particular embodiment illustrated, alternate side walls 46*a* are provided with a negative taper configuration, and preferably a center portion 52 thereof is provided with the desired negative taper. Thus, as indicated in FIG. 11, the alternate walls 46*a* are provided with vertically extending rib-like center projections 52 consisting of lower portions 53 forming a slightly acute angle with the surface of the top wall 12 and extending upward from said surface for a portion of the height of the stud. For example, in a preferred embodiment, the negatively tapered portion may extend upward approximately 0.072 inch. An intermediate portion 54 of the rib-like projection 52 may extend generally straight, i.e., at right angles to the surface of the top wall 12 continuing to an upper portion of the rib-like projection, where the projection is rounded at 55 to merge with the top wall 48.

Thus, in the illustrated form of the invention, the width between the parallel flat surfaces of the alternate stud side walls 46 advantageously is slightly less than the nominal width between the surfaces 42 of the recesses at the entrance thereto. In one advantageous form of the invention, for recesses having a width between opposed side walls of 0.500 inch, the width between alternate stud side wall surfaces 46 may be 0.494. The width across the alternate side wall surfaces 46*a* may be about 0.500 inch. The width across the ribs 52, measuring from the upper portions 54 thereof, is slightly greater than the entrance width of the recesses 13, preferably about 0.502 inch. As shown in FIG. 11, the projecting ribs 52 comprise only a portion of the width of the alternate side walls 46*a*. In a typical embodiment, the width of the ribs may be about 0.063 inch. The arrangement is such that, the projecting ribs 52 of the studs 11 provide an interference fit with the entrance opening of the recesses 13, requiring the studs to be forced through the entrance. Once partially inserted into the recesses, however, wider upper portions of the studs are received in wider inner portions of the recess. Desirably, there is a distinct snap action effect to this assembly, as the wider portion of the stud passes through the narrower entrance of the recess, which can be tactilly sensed through the fingers of the user. This provides a satisfying confirmation that the assembly has been properly completed. Additionally, the negatively tapered configuration of the recesses 13 and the projecting ribs 52 on the studs 11 tends to provide a physical dovetail-like locking action, significantly beyond mere friction, to secure the blocks in their assembled relation.

Figure 16:
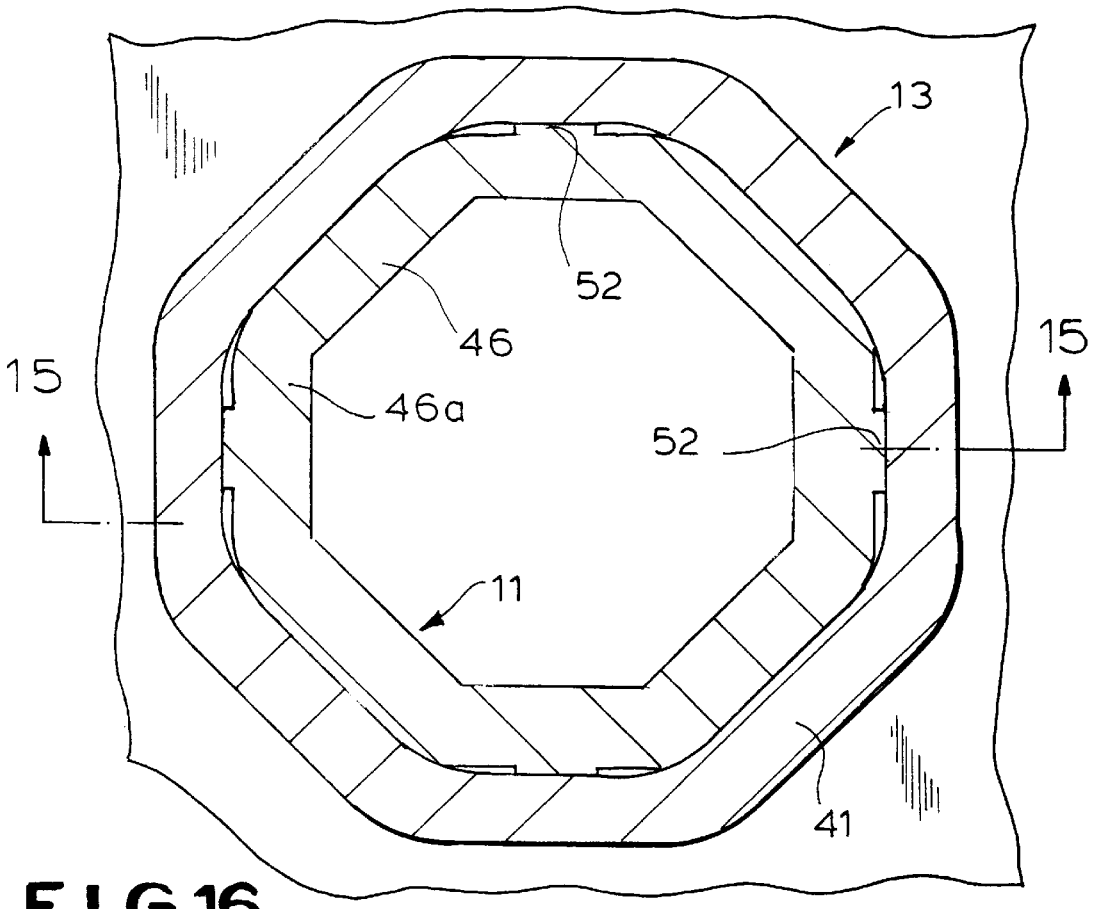
FIG. 16 is a cross sectional view as taken generally on line 16—16 of FIG. 15.
Figure 15:
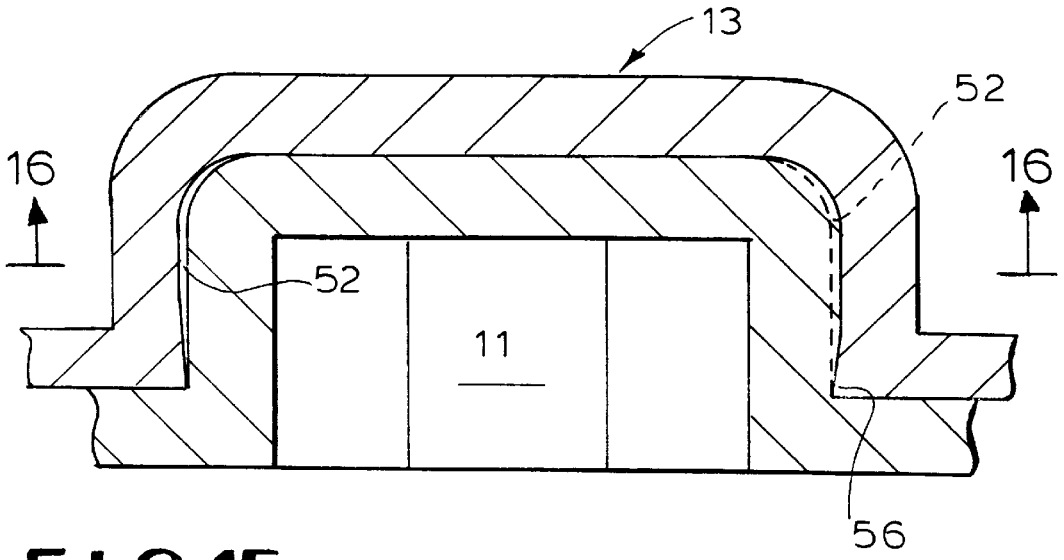
FIG. 15 is a cross sectional view showing the elements of FIGS. 12 and 14 in assembled relation.

FIGS. 15 and 16 illustrate an assembled stud and recess pair. As will be evident in FIG. 15, for example, the narrow entrance opening of the recess 13, as indicated at 56 in FIG. 15, will have to be deformed slightly to accommodate entry of the projecting rib portions 52. The plastic material used in the forming of the block parts, although rigid for most practical purposes, has sufficient elasticity to accommodate the necessary deflection during entry of the stud 11 into the recess 13. Once assembled, the studs are held snugly by the side walls of the recess. And because of the dovetail configuration of the stud and recess walls, the parts are retained very effectively against accidental separation.

Disassembly of assembled blocks when desired is facilitated both by the geometry of the studs and recesses and that of the block bodies themselves. Thus, where the side and end walls of the block bodies join with the top and bottom walls thereof, a generously rounded contour is provided. In one advantageous form of the invention having general dimensions as heretofore described herein, these generously rounded contours, indicated at 60, 61, 62 in FIGS. 8–10 may have a radius of about 0.188. This provides for a limited fingertip access between assembled blocks, in order to obtain a grip thereon and exert some leverage. Thus, when two blocks are joined, depending upon the orientation thereof, a groove for finger access is defined by at least one of the rounded edges, and in some cases by the combined space of two rounded edges. Additionally, the relatively short height of the studs 11, in relation to their width, enables leverage to be exerted on the blocks by tilting one side or one end thereof, or tilting a block from side to side. Such tilting action partially separates the blocks and facilitates the complete separation of a stud from the recess in which it had been inserted.

The device of the invention, although a precision molded product, can be mass produced on an economical basis. The blocks can also be manufactured in a wide variety of sizes and shapes and are by no means limited to the illustrative examples specifically shown and described herein. Accordingly, reference should be made to the following appended claims in determining the full scope of the invention.

What is claimed is:

1. In a construction toy comprised of a plurality of building blocks of the type having a body, one or more studs projecting from a surface of said body, and one or more recesses formed to extend below a surface of said body, and where studs of one building block are adapted to be received in recesses of a second building block, the improvement in said blocks characterized by (a) said studs and said recesses being formed to have an equilateral polygonal configuration, (b) said studs having a predetermined height in relation to the surface of said body from which they project and a predetermined width greater than said height, (c) each of said recesses having an open outer end and an inner end, and being of a sufficient depth to fully receive a stud, (d) said recesses having slightly greater width at regions spaced inward from said outer ends thereof and a slightly narrower width near said outer ends thereof, (e) each of said studs having a base end at said surface and an outer end spaced above said surface, (f) said studs being of slightly greater width near their outer ends than at said base ends and of slightly greater width near their outer ends than the width of the recess open ends near said surface, (g) said recesses being formed with side walls arranged at a slightly acute angle with respect to an outer surface of said body, whereby said recesses have a reversely tapered cross section in a direction from said open ends thereof to said inner ends thereof, and (h) said studs having side walls and at least certain of said stud side walls having portions angled slightly outward from said base ends thereof toward said outer ends thereof, (i) whereby a pair of blocks can be joined by inserting a stud of one block into a recess or another block, with a tactilly sensible snap-action effect, to reliably retain said pair of blocks in said assembled relation.

2. A construction toy according to claim 1, wherein (a) said studs and recesses are formed of a plurality of pairs of side walls, and (b) alternate pairs of side walls of said studs are formed with outwardly angled portions.

3. A construction toy according to claim 1, wherein (a) the width of said studs is greater than twice the height thereof.

4. A construction toy according to claim 1, wherein said studs and recesses have an even number of walls.

5. A construction toy according to claim 4, wherein (a) said studs and recesses are of octagonal configuration.

6. A construction toy according to claim 1, wherein (a) the block bodies are formed with top and bottom walls, and side walls and end walls extending between said top and bottom walls, (b) said one or more studs project from said top walls, and said one or more recesses are formed in, said bottom walls.

7. A construction toy according to claim 6, wherein (a) said one or more studs and said one or more recesses are formed with eight sides arranged in four opposed pairs, (b) the block bodies are formed with spaced apart, parallel side walls and three end walls at each end arranged at angles of 135 degrees to each adjacent wall, (c) opposed pairs of side walls of said studs and said recesses are aligned parallel with side walls of said body, and (c) remaining opposed pairs of side walls of said studs and said recesses are aligned parallel with end walls of said body.

8. A construction toy according to claim 7, wherein (a) said building blocks are formed with a single stud and a single recess, and (b) the side walls and end walls of said body are of equal size and spaced uniformly from adjacent side walls of said stud and said recess.

9. A construction toy according to claim 7, wherein (a) said building blocks are formed with a plurality of studs and an equal plurality of recesses, (b) said studs and recesses are aligned with a common plane containing a central axis of each stud and each recess, (c) said block body is symmetrically disposed with respect to said common plane, (d) the side walls of said body are parallel to said common plane and to a side wall pair of each of said studs and each of said recesses and spaced a predetermined distance therefrom, (e) at least two studs and two recesses are located adjacent opposite ends of said block body, and (f) the end walls of said block body are aligned parallel with adjacent side walls of said studs and recesses and are spaced therefrom said predetermined distance.

10. A construction toy according to claim 9, wherein (a) said building blocks are formed with at least three studs and recesses, and (b) a stud or recess adjacent any other stud or recess being separated therefrom a distance equal to twice said predetermined distance.

* * * * *